US011562681B2

(12) United States Patent
Li et al.

(10) Patent No.: US 11,562,681 B2
(45) Date of Patent: Jan. 24, 2023

(54) DISPLAY SUBSTRATE, DRIVING METHOD THEREOF AND DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventors: Ting Li, Beijing (CN); Yuanjie Xu, Beijing (CN); Bo Wu, Beijing (CN); Zhonglin Cao, Beijing (CN); Pengcheng Zang, Beijing (CN); Jing He, Beijing (CN); Yadong Zhang, Beijing (CN); Yao Li, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 25 days.

(21) Appl. No.: 16/984,939

(22) Filed: Aug. 4, 2020

(65) Prior Publication Data

US 2021/0193019 A1 Jun. 24, 2021

(30) Foreign Application Priority Data

Dec. 19, 2019 (CN) ..... 201922298083.8

(51) Int. Cl.
*G09G 3/20* (2006.01)

(52) U.S. Cl.
CPC ... *G09G 3/2092* (2013.01); *G09G 2310/0267* (2013.01); *G09G 2310/0275* (2013.01)

(58) Field of Classification Search
CPC ..... G09G 3/2092; G09G 2310/0267; G09G 2310/0275
See application file for complete search history.

(56) References Cited

U.S. PATENT DOCUMENTS

2018/0129111 A1* 5/2018 Wu ..... G02F 1/13454

* cited by examiner

*Primary Examiner* — Alexander Eisen
*Assistant Examiner* — Nathaniel P Brittingham
(74) *Attorney, Agent, or Firm* — Nath, Goldberg & Meyer; Joshua B. Goldberg

(57) ABSTRACT

The disclosure provides a display substrate, a driving method thereof and a display device. The display substrate includes: a base substrate with a hole in a hole region of the base substrate; a plurality of first signal lines, on a first side of the hole; and a plurality of second signal lines, on the other side of the hole distal to the first side; a plurality of first switch units, at terminals of the plurality of first signal lines proximal to the hole and electrically coupled to the plurality of first signal lines in one-to-one correspondence; a plurality of second switch units, at terminals of the plurality of second signal lines proximal to the hole; a plurality of connection lines comprising a plurality of first connection lines, a plurality of second connection lines and a plurality of third connection lines.

11 Claims, 10 Drawing Sheets

DISPLAY SUBSTRATE, DRIVING METHOD THEREOF AND DISPLAY DEVICE

CROSS-REFERENCE TO RELATED APPLICATIONS

The present disclosure claims the priority of Chinese Patent Application No. 201922298083.8, filed on Dec. 19, 2019, the contents of which are incorporated herein by reference in its entirety.

TECHNICAL FIELD

The disclosure relates to the technical field of display, and in particular to a display substrate, a driving method thereof, and a display device.

BACKGROUND

Recently, the terminal devices such as full active screens have become more and more popular, in generally a hole is formed in a hole region on a top portion of a display panel of such a terminal device in the industry, and module components such as a camera, an earphone and a sensor are embedded into the hole.

The inventor has found, in the related art, that signal lines such as scanning lines and data lines of the display panel need to be wound around the hole, the hole region needs to be coated with the bezel sealing adhesive, and the cured bezel sealing adhesive has a certain transmittance/transmissivity, therefore the number of the windings around the hole affects the display effect of display device around the hole. Along with the requirement of users for a bezel of where the hole region is located is higher and higher, the wiring difficulty around the hole has increased due to too many signal lines, and the product yield is influenced.

SUMMARY

As an aspect, a display substrate is provided. The display substrate includes: a base substrate with a hole in a hole region of the base substrate; a plurality of first signal lines, on a first side of the hole; a plurality of second signal lines, on the other side of the hole distal to the first side, the plurality of first signal lines being in one-to-one correspondence with the plurality of second signal lines, and both of the plurality of first signal lines and the plurality of second signal lines extending along a first direction; a plurality of first switch units, at terminals of the plurality of first signal lines proximal to the hole and electrically coupled to the plurality of first signal lines in one-to-one correspondence; a plurality of second switch units, at terminals of the plurality of second signal lines proximal to the hole and electrically coupled to the plurality of second signal lines in one-to-one correspondence; a plurality of connection lines comprising a plurality of first connection lines, a plurality of second connection lines and a plurality of third connection lines, both of the plurality of first connection lines and the plurality of second connection lines extending along a second direction, the plurality of third connection lines extending along the first direction, and the first direction being substantially perpendicular to the second direction; a plurality of timing signal lines, extending along the second direction. The plurality of first switch units are divided into groups. In each group of first switch units, first terminals of first switch units are respectively coupled to corresponding first signal lines, second terminals of the first switch units are coupled to a single first connection line, and control terminals of the first switch units are respectively coupled to different timing signal lines. The plurality of second switch units are divided into groups. In each group of second switch units, first terminals of second switch units are respectively coupled to corresponding second signal lines, second terminals of the second switch units are coupled to a single second connection line, and control terminals of the second switch units are respectively coupled to the different timing signal lines. Each group of first switch units is coupled to a corresponding group of second switch units through a single third connection line of the plurality of third connection lines.

In an embodiment, the plurality of timing signal lines are arranged on both sides of the hole in an axisymmetric manner with a straight line passing through a center of the hole along the second direction as an axis, and the plurality of timing signal lines are coupled to a plurality of timing signal terminals, respectively.

In an embodiment, each of the first switch units includes a first switch transistor, and each of the second switch units includes a second switch transistor. Among each group of first switch transistors and the corresponding group of second switch transistors connected through the single third connection line, a control electrode of one first switch transistor and a control electrode of one corresponding second switch transistor are coupled to a same timing signal terminal.

In an embodiment, multiple sequentially adjacent first switch transistors are grouped into one group, and multiple sequentially adjacent second switch transistors are grouped into one group.

In an embodiment, the plurality of first switch transistors are numbered from left to right, odd-numbered first switch transistors are grouped into one group, and even-numbered first switch transistors are grouped into another group. The plurality of second switch transistors are numbered from left to right, odd-numbered second switch transistors are grouped into one group, and even-numbered second switch transistors are grouped into another group.

In an embodiment, the first signal line is a first data line, and the second signal line is a second data line. Three sequentially adjacent first switch transistors are grouped into one group, and three sequentially adjacent second switch transistors are grouped into one group.

In an embodiment, the first data lines respectively correspond to the red sub-pixel, the green sub-pixel and the blue sub-pixel, and the second data lines respectively correspond to the red sub-pixel, the green sub-pixel and the blue sub-pixel. Among each group of first switch transistors and the corresponding group of second switch transistors connected through the single third connection line, a control electrode of one first switch transistor and a control electrode of one corresponding second switch transistor corresponding to a same color sub-pixel are coupled to a same timing signal terminal.

In an embodiment, the single third connection line is electrically coupled to the first connection line and the second connection line at the green sub-pixel.

In an embodiment, the first signal line is a first data line, and the second signal line is a second data line. The plurality of first switch transistors are numbered from left to right, three odd-numbered first switch transistors are grouped into one group, and three even-numbered first switch transistors are grouped into another group. The plurality of second switch transistors are numbered from left to right, three odd-numbered second switch transistors are grouped into one group, and three even-numbered second switch transistors are grouped into another group.

In an embodiment, the plurality of first data lines respectively correspond to the red sub-pixel, the green sub-pixel and the blue sub-pixel, and the plurality of second data lines respectively correspond to the red sub-pixel, the green sub-pixel and the blue sub-pixel. Among each group of first switch transistors and the corresponding group of second switch transistors connected through the single third connection line, a control electrode of one first switch transistor and a control electrode of one corresponding second switch transistor corresponding to a same color sub-pixel are coupled to a same timing signal terminal.

In an embodiment, the single third connection line is electrically coupled to the first connection line and the second connection line at the green sub-pixel.

In an embodiment, the plurality of timing signal terminals includes a first timing signal terminal, a second timing signal terminal, and a third timing signal terminal. The plurality of timing signal lines includes a first timing signal line, a second timing signal line, and a third timing signal line. A control electrode of a first switch transistor corresponding to the red sub-pixel in each group of first switch transistors is coupled to the first timing signal terminal via the first timing signal line, and a control electrode of a second switch transistor corresponding to the red sub-pixel in the corresponding group of second switch transistors is coupled to the first timing signal terminal via the first timing signal line. A control electrode of a first switch transistor corresponding to the green sub-pixel in each group of first switch transistors is coupled to the second timing signal terminal via the second timing signal line, and a control electrode of a second switch transistor corresponding to the green sub-pixel in the corresponding group of second switch transistors is coupled to the second timing signal terminal via the second timing signal line. A control electrode of a first switch transistor corresponding to the blue sub-pixel in each group of first switch transistors is coupled to the third timing signal terminal via the third timing signal line, and a control electrode of a second switch transistor corresponding to the blue sub-pixel in the corresponding group of second switch transistors is coupled to the third timing signal terminal via the third timing signal line.

In an embodiment, each of the first switch transistor and the second switch transistor is N-type transistor.

In an embodiment, an orthographic projection of the third connection line on the base substrate does not overlap an orthographic projection of the hole on the base substrate.

As another aspect, a display device including above display substrate and a driving circuit for driving the display substrate is provided.

As another aspect, a method for driving above display substrate is provided. The method includes: outputting, by the first timing signal terminal, a square wave pulse occupying one third of a cycle, so as to drive a first switch transistor and a second switch transistor coupled to the first timing signal terminal to be turned on; outputting, by the second timing signal terminal, a square wave pulse occupying one third of a cycle immediately after the square wave pulse output by the first timing signal terminal, so as to drive a first switch transistor and a second switch transistor coupled to the second timing signal terminal to be turned on, and outputting, by the third timing signal terminal, a square wave pulse occupying one third of a cycle immediately after the square wave pulse output by the second timing signal terminal, so as to drive a first switch transistor and a second switch transistor coupled to the third timing signal terminal to be turned on.

DETAILED DESCRIPTION

In order to enable those skilled in the art to better understand the technical solutions of the present disclosure, the present disclosure will be described in detail below with reference to the accompanying drawings and the specific embodiments.

Figure 1:
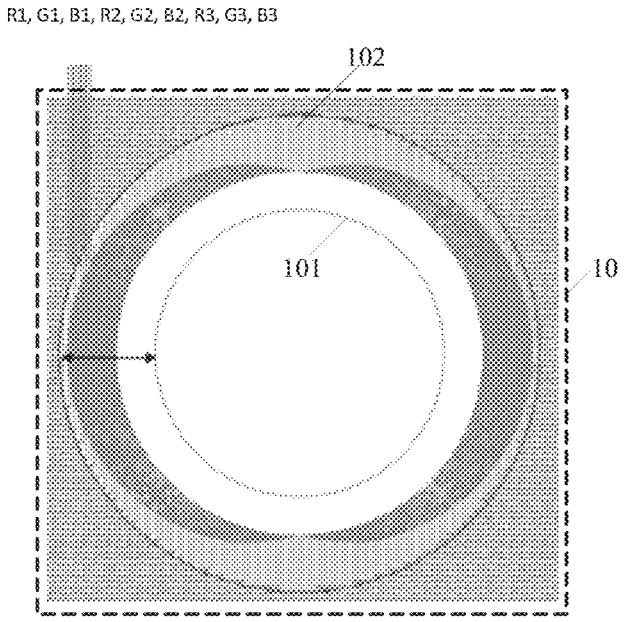
Related art FIG. 1
FIG. 1 is a schematic diagram showing a structure of a display substrate according to the related art.

FIG. 1 is a schematic diagram showing a structure of a display substrate in the related art. As shown in FIG. 1, the display substrate has an hole region 10 in which a hole 101 is formed. A plurality of signal lines 102 are formed around the hole 101. The signal lines 102 need to be arranged around the hole 101, that is, the plurality of signal lines 102 surround the hole 101. When the display substrate is packaged, the bezel sealing adhesive is coated around the hole 101. Since a large number of dense signal lines 102 are arranged around the hole 101, the transmittance/transmissivity of the bezel sealing adhesive is easily affected, the display effect around the hole 101 is affected, and in turn the bezel nearby the hole 101 is further affected as well. Along with the requirement of users for a bezel of where the hole region is located is higher and higher, the wiring difficulty around the hole has increased due to too many signal lines, and the product yield is influenced.

In order to reduce the number of signal lines around the hole 101, the present disclosure provides a display substrate and a display device, which will be described in further detail with reference to the accompanying drawings and the detailed description below.

Figure 2:
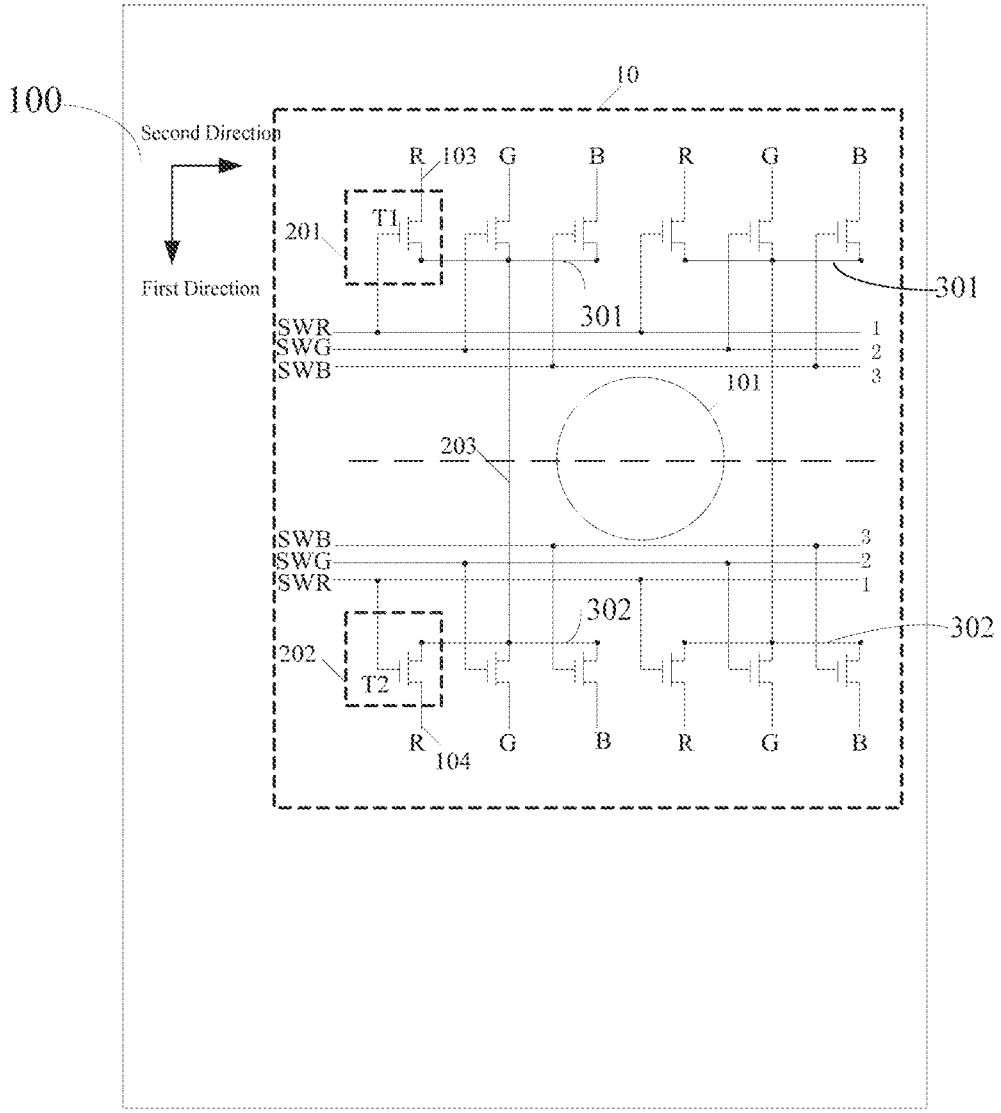
FIG. 2 is a schematic diagram showing a structure of a display substrate according to an embodiment of the disclosure.

FIG. 2 is a schematic diagram showing a structure of a display substrate according to an embodiment of the disclosure. As shown in FIG. 2, the display substrate includes: a base substrate 100 with a hole 101 formed in a hole region 10 of the base substrate 100; a plurality of first signal lines 103, on a first side of the hole (e.g., upper side); a plurality of second signal lines 104, on the other side (e.g., lower side) of the hole 101 distal to the first side, wherein the plurality of first signal lines 103 are in one-to-one correspondence with the plurality of second signal lines 104, both of the plurality of first signal lines 103 and the plurality of second signal lines 104 extend along a first direction; and an extending direction of a part of the plurality of first signal lines 103 and the plurality of second signal lines 104 passes through the hole 101; a plurality of first switch units 201, at terminals of the plurality of first signal lines 103 proximal to the hole 101 and electrically coupled to the plurality of first signal lines 103 in one-to-one correspondence; a plurality of second switch units 202, at terminals of the plurality of second signal lines 104 proximal to the hole 101 and electrically coupled to the plurality of second signal lines 104 in one-to-one correspondence; a plurality of connection lines including a plurality of first connection lines 301, a plurality of second connection lines 302 and a plurality of third connection lines 203, wherein both of the plurality of first connection lines 301 and the plurality of second connection lines 302 extend a second direction, the plurality of third connection lines 203 extend along the first direction, and the first direction is substantially perpendicular to the second direction; and a plurality of timing signal lines SW, extending along the second direction. The plurality of first switch units 201 are divided into groups. In each group of first switch units, first terminals of the first switch units are respectively coupled to corresponding first signal lines, second terminals of the first switch units are coupled to a single first connection line 301, and control terminals of the first switch units are respectively coupled to different timing signal lines. The plurality of second switch units are divided into groups. In each group of second switch units, first terminals of the second switch units are respectively coupled to corresponding second signal lines, second terminals of the second switch units are coupled to a single second connection line 302, and control terminals of the second switch units are respectively coupled to the different tinning signal lines. Each group of first switch units is coupled to a corresponding group of second switch units through a single third connection line of the plurality of third connection lines 203.

Under the control of a timing signal, a signal on the first signal line 103 is input to a corresponding second signal line 104 through the third connection line 203. An orthographic projection of the third connection line 203 on the base substrate 100 does not overlap an orthographic projection of the hole 101 on the base substrate 100.

It should be noted that, since a large number of the first signal lines 103 and the second signal lines 104 are formed, in the drawings of the embodiments of the present disclosure, only six (6) first signal lines 103 and six (6) second signal lines 104 are shown, and an embodiment in which six (6) first signal lines 103 and six (6) second signal lines 104 are formed is taken as an example for description. In addition, nine (9) first signal lines 103 and nine (9) second signal lines 104 may be formed on both sides of the hole 101. Alternatively, 3*n (n equals to or is greater than 1) first signal lines 103 and 3*n second signal lines 104 may be formed on both sides of the hole 101.

In the display substrate provided by the embodiment of the disclosure, two sides (e.g., the left side and the right side) of the hole 101 are respectively provided with a plurality of first signal lines 103 and a plurality of second signal lines 104. one terminal of the first signal line 103 proximal to the hole 101 is coupled to a first switch unit 201, and one terminal of the second signal line 104 proximal to the hole 101 is coupled to a second switch unit 202. The first switch units 201 are coupled to corresponding second switch units 202 through a single third connection line 203. The number of the third connection lines 203 may be set according to actual requirement. For example, as shown in FIG. 2, every three first switch units 201 may be coupled to corresponding three second switch units 202 through the single third connection line 203. As such, three signal lines which originally need to be arranged around the hole 101 can be combined into one third connection line 203. Under the control of a timing signal, a signal on the first signal line 103 can be input into the corresponding second signal line 104 through the single third connection line 203. Therefore, the number of lines needed to be arranged around the hole 101 can be reduced to one third of the original number, thereby reducing the number of lines around the hole 101, improving the transmittance of the bezel sealing adhesive around the hole 101, and in turn improving the display effect around the hole 101. In addition, the wiring difficulty around the hole 101 can also be reduced due to the fewer lines around the hole 101, and the product yield can be improved.

In one embodiment, as shown in FIG. 2, in the display substrate, the first switch unit 201 includes a first switch transistor T1, and the second switch unit 202 includes a second switch transistor T2. First electrodes of multiple first switch transistors T1 are coupled to first signal lines 103 respectively, second electrodes of the multiple first switch transistors T1 are coupled to a single first connection line 301 and control electrodes of the multiple first switch transistors T1 are coupled to different timing signal terminals SWR, SWG, and SWB, respectively. First electrodes of multiple second switch transistors T2 are coupled to a plurality of second signal lines 104 respectively, second electrodes of the multiple second switch transistors T2 are coupled to a single second connection line 302, and control electrodes of the second switch transistors T2 are coupled to the different timing signal terminals SWR, SWG, and SWB, respectively. One first connection line 301 is coupled to a corresponding second connection line 302 via a single third connection line 203.

It should be noted that the signals in the first signal line 103 may be input to the first electrode of the first switch transistor T1, and a timing signal may be received by the control electrode of the first switch transistor T1. The timing signal may control on and off of each of the first switch transistors T1, so as to ensure that only one of the first switch transistors T1 is turned on at a time, and thus, a signal in only one of the first signal lines 103 may be input into the third connection line 203 through the second electrode of the first switch transistor T1 at a time. It can be ensured that only one of the second switch transistors T1 is turned on at a time under the control of the same timing signal, and thus a signal in the third connection line 203 may be input into the corresponding second signal line 104, so that the signals in the first signal lines 103 can be sequentially input into the corresponding second signal lines 104 respectively, thereby reducing the number of lines wound around the hole 101, improving the transmittance of the bezel sealing adhesive around the hole 101, and in turn improving the display effect around the hole 101.

Figure 3:
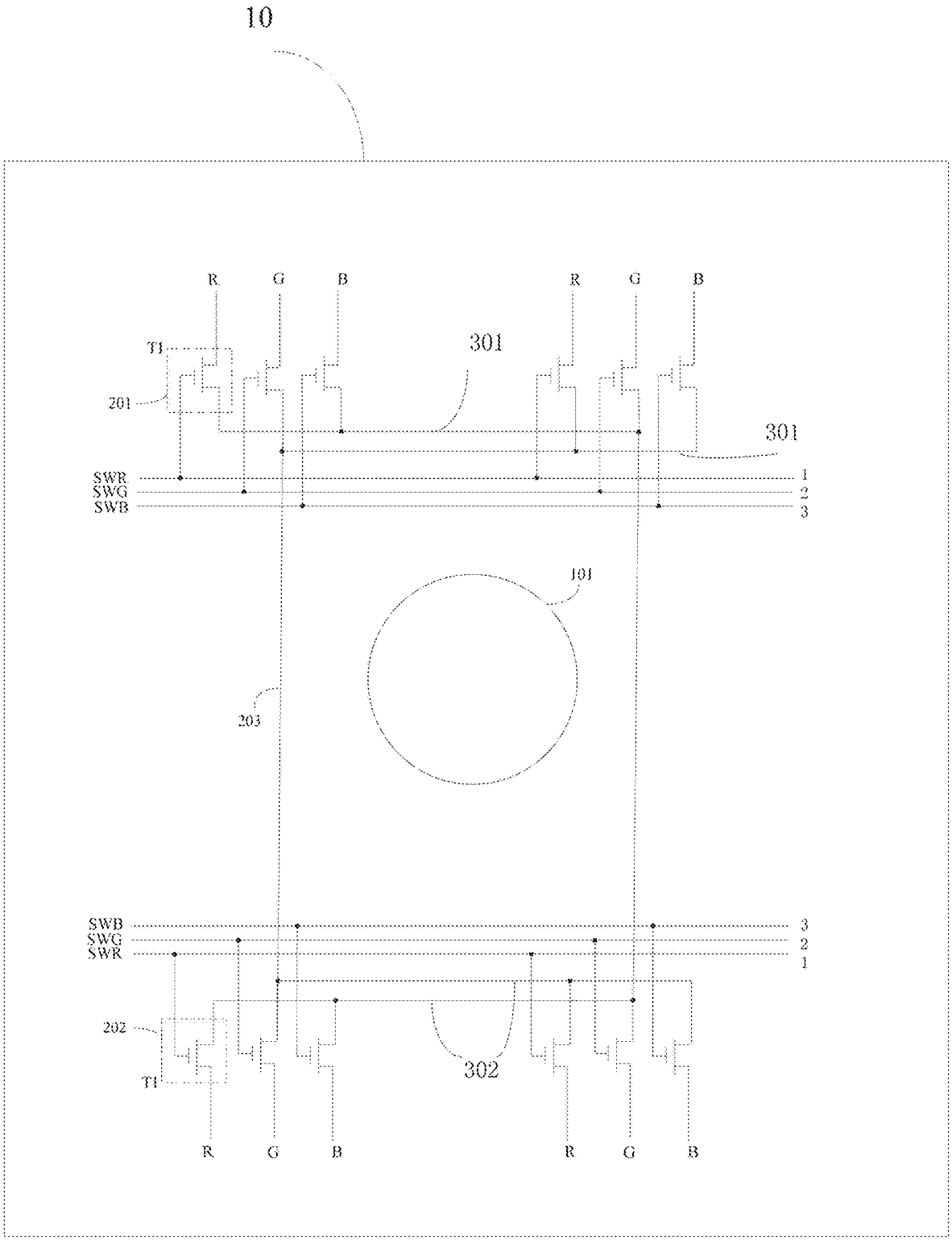
FIG. 3 is a schematic diagram showing a structure of a display substrate according to an embodiment of the disclosure.

FIG. 3 is a schematic diagram showing a structure of a display substrate according to an embodiment of the disclosure. As shown in FIG. 3, the control electrodes of the first switch transistors T1 having the second electrodes coupled to terminals of different third connection lines 203 are all coupled to the same timing signal terminal; the control electrodes of the second switch transistors T2 having the second electrodes coupled to the other terminals of the different third connection lines 203 are all coupled to the same timing signal terminal.

It should be noted that, the plurality of first signal lines 103 are coupled to the plurality of corresponding first switch transistors T1, the plurality of second signal lines 104 are coupled to the plurality of corresponding second switch transistors T2, and the control electrode of each of the first switch transistors T1 and the second switch transistors T2 needs to be coupled to a corresponding timing signal terminal, therefore in order to reduce the number of connection lines to which the control electrodes are connected, in the embodiment, the second electrodes of the plurality of first switch transistors T1, with control electrodes all coupled to the same timing signal terminal, may be coupled to terminals of different third connection lines 203, and the second electrodes of the plurality of second switch transistors T2, with control electrodes all coupled to the same timing signal terminal, may be coupled to the other terminals of the different third connection lines 203. In this way, it can be ensured that the signal in only one of the first signal lines 103 is input into one corresponding second signal line 104 via one third connection line 203 at a time, and in turn the signals in the first signal lines 103 can be sequentially input into the corresponding second signal lines 104 via the third connection line 203 respectively. Therefore, a smaller number of timing signal terminals can be used to control a larger number of first switch transistors T1 and second switch transistors T2, and signals in the first signal lines 103 may be input into the corresponding second signal lines 104 through the third connection lines 203, thereby reducing the number of timing signal lines, improving the transmittance of the bezel sealing adhesive around the hole 101, and improving the display effect around the hole 101.

Optionally, as shown in FIG. 2, multiple (e.g., three) first switch transistors T1 that are sequentially adjacent are grouped into one group. In each group of first switch transistors T1, first electrodes of the first switch transistors T1 are respectively coupled to multiple (i.e., three) first signal lines 103 sequentially adjacent, second electrodes of the first switch transistors T1 are all coupled to a single first connection line 301, and control electrodes of the first switch transistors T1 are respectively coupled to the different timing signal terminals SWR, SWG, and SWB. Multiple (e.g., three) second switch transistors T2 sequentially adjacent are grouped into one group. In each group of second switch transistors T2, first electrodes of the second switch transistors T2 are respectively coupled to multiple (e.g., three) second signal lines 104 sequentially adjacent, second electrodes of the second switch transistors T2 are all coupled to a single second connection line 302, and control electrodes of the second switch transistors T2 are respectively coupled to the different timing signal terminals SWR, SWG, and SWB. The first connection line 301 is electrically coupled to the second connection line 302 via a single third connection line 203.

It should be noted that, for convenience of wiring, multiple first switch transistors T1 that are sequentially adjacent may be grouped into one group. As such, it can be ensure that only one of the first switch transistors T1 in each group is turned on at a time, and a signal in a first signal line 103 coupled to the turned-on first switch transistor T1 is input into a corresponding second signal line 104, and thus signals in the first signal lines 103 are sequentially input into the corresponding second signal lines 104 through the third connection line 203. Accordingly, multiple second switch transistors T2 that are sequentially adjacent may be grouped in the same manner, thereby reducing the wiring difficulty of the entire display substrate, and improving the product yield. In the embodiment, the number of groups of the first switch transistors is equal to the number of connection lines.

In one embodiment, as shown in FIG. 3, multiple (e.g., three) first switch transistors T1 with one transistor spaced between every two of the multiple first switch transistors T1 are divided into one group. In each group, first electrodes of the first switch transistors T1 are respectively coupled to multiple (e.g., three) first signal lines 103 with one first signal line spaced between any two adjacent first signal lines 103, second electrodes of the first switch transistors T1 are all coupled to a single first connection line 301, and control electrodes of the first switch transistors T1 are respectively coupled to the different timing signal terminals SWR, SWG, and SWB. Multiple (e.g., three) second switch transistors T2 with one transistor spaced between every two of the multiple (e.g., three) second switch transistors T2 belong to the same group; in each group, first electrodes of the second switch transistors T2 are respectively coupled to multiple (e.g., three) second signal lines 104 with one second signal line spaced between every two of them, second electrodes of the second switch transistors T2 are all coupled to a single second connection line 302, and control electrodes of the second switch transistors T2 are respectively coupled to the different timing signal terminals SWR, SWG, and SWB. The first connection line 301 is electrically coupled to a corresponding second connection line 302 via a single third connection line 203

It should be noted that, for convenience of wiring, multiple first switch transistors T1 with one transistor spaced between every two of them may be grouped into one group. As such, only one of the first switch transistors T1 in each group is turned on at a time, and a signal in the first signal line 103 coupled to the turned-on first switch transistor T1 is input to one corresponding second signal line 104, and thus, the signals in the first signal lines 103 are sequentially input to the corresponding second signal lines 104 through the third connection line 203. Accordingly, multiple second switch transistors T2 with one transistor spaced between every two of them can be grouped in the same manner, thereby reducing the wiring difficulty of the entire display substrate, and improving the yield of the product. In the embodiment, only two connection lines are required.

Optionally, among each group of first switch transistors T1 and a corresponding group of second switch transistors T2 that are connected via the same third connection line 203, a control electrode of only one first switch transistor T1 and a control electrode of only one second switch transistor T2 are coupled to the same timing signal terminal.

Among groups of first switch transistors, the control electrode of only one first switch transistor T1 in each group is coupled to a same timing signal terminal. Among groups of second switch transistors, the control electrode of only one second switch transistor T2 in each group is coupled to a same timing signal terminal.

In one embodiment, in each group of first switch transistors T1, a control electrode of one first switch transistor T1 is coupled to the timing signal terminal SWR; a control electrode of one first switch transistor T1 is coupled to the timing signal terminal SWG; a control electrode of one first switch transistor T1 is coupled to the timing signal terminal SWB. In this way, it can be ensured that only one of the first switch transistors T1 is turned on at a time, and the signal in the first signal line 103 coupled to the turned-on first switch transistor T1 is inputted into one corresponding second signal line 104, and the signals in the first signal lines 103 may be sequentially input into the corresponding second signal lines 104 through the third connection line 203, respectively. Therefore, a smaller number of timing signal lines can be used to control a larger number of first switch transistors T1 and second switch transistors T2, and the signals in first signal lines 103 can be input into the corresponding second signal lines 104 through the third connection lines 203 respectively, thereby reducing the number of timing signal lines, improving the transmittance of the bezel sealing adhesive around the hole 101, and improving the display effect around the hole 101.

In a specific example, as shown in FIG. 2, the first signal line 103 is first data lines, and the second signal line 104 is second data line. Three sequentially adjacent first switch transistors T1 are grouped into one group; in each group of first switch transistors T1, the first electrodes of three adjacent first switch transistors T1 are respectively coupled to three adjacent first data lines, the second electrodes of three adjacent first switch transistors T1 are all coupled to a single first connection line 301, and the control electrodes of three adjacent first switch transistors T1 are respectively coupled to the different timing signal terminals SWR, SWG, and SWB. Three sequentially adjacent second switch transistors T2 are grouped into one group; in each group of second switch transistors T2, the first electrodes of three adjacent second switch transistors T2 are respectively coupled to three adjacent second data lines, the second electrodes of three adjacent second switch transistors T2 are all coupled to a single second connection line 302, and the control electrodes of three adjacent second switch transistors T2 are respectively coupled to the different timing signal terminals SWR, SWG, and SWB.

It should be noted that three first switch transistors T1 sequentially adjacent are grouped into one group. The first electrodes of the three adjacent first switch transistors T1 are coupled to the corresponding three first data lines that are adjacent in sequence, and corresponding data signals may be sequentially input into the corresponding three second data lines that are adjacent in sequence from the three first data lines that are adjacent in sequence, under the control of the timing signal. In addition, three adjacent second switch transistors T2 may also be grouped into one group. The signals in the three adjacent first data lines may be input into the corresponding three adjacent second data lines, under the control of the timing signal. In practical applications, three timing signal terminals including a first timing signal terminal SWR, a second timing signal terminal SWG, and a third timing signal terminal SWB may be provided.

Since the three adjacent first data lines respectively correspond to a red sub-pixel R, a green sub-pixel G and a blue sub-pixel B, and the control electrodes of the first switch transistors T1 corresponding to a same color in groups may be coupled to a same timing signal terminal, a smaller number of timing signal lines can be used for controlling a larger number of first switch transistors T1 and second switch transistors T2, and signals of the first data lines may be input into the corresponding second data lines through the third connection lines 203, thereby reducing the number of timing signal lines, improving the transmittance of the bezel sealing adhesive around the hole 101, and improving the display effect around the hole 101. In the present embodiment, the number of groups of the first switch transistor is equal to the number of connection lines. For example, the plurality of first switch transistors are grouped into two groups, and two connection lines are required to be set; for another example, the plurality of first switch transistors are grouped into three groups, and three connection lines are required to be set. The number of connection lines is not limited thereto here.

In one embodiment, as shown in FIG. 3, the first signal line 103 is a first data line 103, and the second signal line 104 is a second data line 104. Three first switch transistors T1 with one first transistor spaced between every two of them are grouped into one group, that is, from left to right, the $1^{st}$, $3^{rd}$, $5^{th}$ first switch transistors T1 are grouped into one group, and the $2^{nd}$, $4^{th}$, $6^{th}$ first switch transistors T1 are grouped into another group. In each group of first switch transistors T1, the first electrodes of three first switch transistors T1 (e.g., the $1^{st}$, $3^{rd}$, $5^{th}$ first switch transistors T1) are respectively coupled to corresponding three first data lines 103 spaced with each other, one first data line is between every two of the corresponding three first data lines 103. The second electrodes of the three first switch transistors T1 are all coupled to a single first connection line 301. The control electrodes of the three first switch transistors T1 are coupled to the different timing signal terminals SWR, SWG, and SWB, respectively. Three second switch transistors T2 with one second transistor spaced between every two of them are grouped into one group, that is, from left to right, the $1^{st}$, $3^{rd}$, $5^{th}$ second switch transistors T2 are grouped into one group, and the $2^{nd}$, $4^{th}$, $6^{th}$ second switch transistors T2 are grouped into another group. In each group of second switch transistors T2, the first electrodes of three second switch transistors T2 (e.g., the $1^{st}$, $3^{rd}$, $5^{th}$ second switch transistors T2) are respectively coupled to corresponding three second data lines 104, one second data line is between every two of the corresponding three second data lines 104. The second electrodes of the three second switch transistors T2 are all coupled to a single second connection line 302. The control electrodes of the three second switch transistors T2 are coupled to the different timing signal terminals SWR, SWG, and SWB, respectively. The single third connection line 203 is electrically coupled to the first connection line 301 and the second connection line 302 at the green sub-pixel. In the embodiment, only two third connection lines are provided.

It should be noted that, three first switch transistors T1 with one first switch transistor spaced between every two of them are grouped into one group. The first electrodes of the three first switch transistors T1 are coupled to the corresponding three first data lines 103 with one first data line spaced between every two of them. Data signals on the corresponding data lines 103 may be sequentially input to the third connection line 203 under the control of a timing signal. Accordingly, three second switch transistors T2 with one second switch transistor spaced between every two of them are grouped into another group. A signal in the first data line 103 may be input to the corresponding second data line 104 under the control of a timing signal. In practical applications, three timing signal terminals including the first timing signal terminal SWR, the second timing signal terminal SWG and the third timing signal terminal SWB may be provided.

Since the three first data lines 103 with one first data line spaced between every two of them respectively correspond to the red, green, and blue sub-pixels R, G, and B, the control electrodes of the first switch transistor T1 corresponding to the same color sub-pixel in each group may be coupled to the same timing signal terminal. That is to say, the control electrodes of the first switch transistor T1 corresponding to the red sub-pixel in each group of first switch transistors T1 is coupled to the first timing signal terminal SWR via a first timing signal line 1, and the control electrodes of the second switch transistor T2 corresponding to the red sub-pixel in each group of second switch transistors T2 is coupled to the first timing signal terminal SWR via the first timing signal line 1. The control electrodes of the first switch transistor T1 corresponding to the green sub-pixel G in each group of first switch transistors T1 is coupled to the second timing signal terminal SWG via the second timing signal line 2, and the control electrodes of the second switch transistor T2 corresponding to the green sub-pixel G in each group of second switch transistors T2 is coupled to the second timing signal terminal SWG via the second timing signal line 2. The control electrodes of the first switch transistor T1 corresponding to the blue sub-pixel B in each group of first switch transistors T1 is coupled to the third timing signal terminal SWB via the third timing signal line 3, and the control electrodes of the second switch transistor T2 corresponding to the blue sub-pixel B in each group of second switch transistors T2 is coupled to the third timing signal terminal SWB via the third timing signal line 3.

Therefore, a smaller number of timing signal lines can be used to control a larger number of first switch transistors T1 and second switch transistors T2, and signals in the first data lines may be input into the corresponding second data lines through the third connection lines 203, thereby reducing the number of timing signal lines, improving the transmittance of the bezel sealing adhesive around the hole 101, and improving the display effect around the hole 101.

Based on the display substrate shown in FIG. 3, in practical applications, three timing signal terminals including the first timing signal terminal SWR, the second timing signal terminal SWG and the third timing signal terminal SWB may be provided, and each of the switch transistors may be an N-type transistor. The timing signal line includes the first timing signal line1, the second timing signal line2 and the third timing signal line3. The timing signal line 1, 2 and 3 are arranged on both sides of the hole 101 in an axisymmetric manner with a straight line passing through a center of the hole 101 along the second direction as an axis, and the plurality of timing signal lines are coupled to the timing signal terminals SWR, SWG, SWB, respectively.

Figure 4:
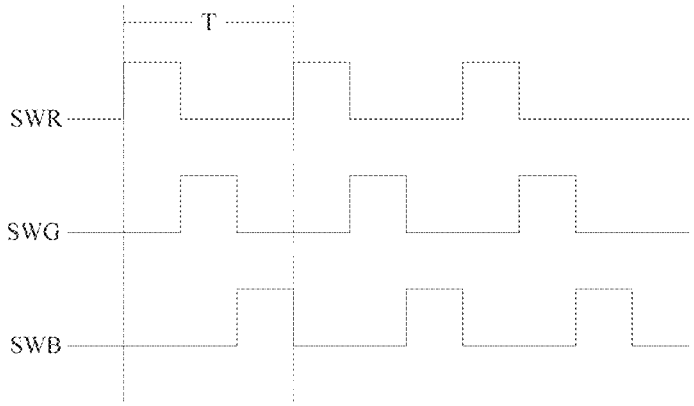
FIG. 4 is a waveform diagram showing a timing signal for controlling a display substrate according to an embodiment of the disclosure.

FIG. 4 is a waveform diagram showing a timing signal for controlling a display substrate according to an embodiment of the disclosure. As shown in FIG. 4, during each period T, the first timing signal terminal SWR, the second timing signal terminal SWG, and the third timing signal terminal SWB may output one square wave pulse respectively, and each square wave pulse has a duration of one third of the cycle T, that is, the three timing signal terminals sequentially output one square wave pulse during the period T. In one embodiment, when the first timing signal terminal SWR stops outputting one square wave pulse which takes up one third of the cycle T (i.e., T/3), the second sequence signal terminal SWG outputs one square wave pulse which takes up one third of the cycle T immediately after the square wave pulse output by the first timing signal terminal SWR. When the second timing signal terminal SWG stops outputting the square wave pulse having one third of the cycle T, the third timing signal terminal SWB outputs one square wave pulse occupying one third of the cycle T immediately after the square wave pulse output by the second timing signal terminal SWG.

When the first timing signal terminal SWR outputs a high level signal, the first switch transistors T1 and the corresponding second switch transistors T2 coupled to the timing signal terminal SWR are turned on, and at this time, the first data lines corresponding to the red sub-pixels R may be coupled to the corresponding second data lines through the third connection lines 203 respectively. Similarly, when the second timing signal terminal SWG outputs a high level signal, the first data lines corresponding to the green sub-pixels G may be coupled to the corresponding second data lines through the third connection lines 203, respectively. When the third timing signal terminal SWB outputs a high level signal, the first data lines corresponding to the blue sub-pixels B may be coupled to the corresponding second data lines through the third connection lines 203, respectively. In this way, the display of the whole display screen can be realized by using fewer third connection lines 203 around the hole 101 and fewer timing signal lines, thereby reducing the number of lines around the hole 101, improving the transmittance of the bezel sealing adhesive around the hole 101, and improving the display effect around the hole 101.

Figure 5:
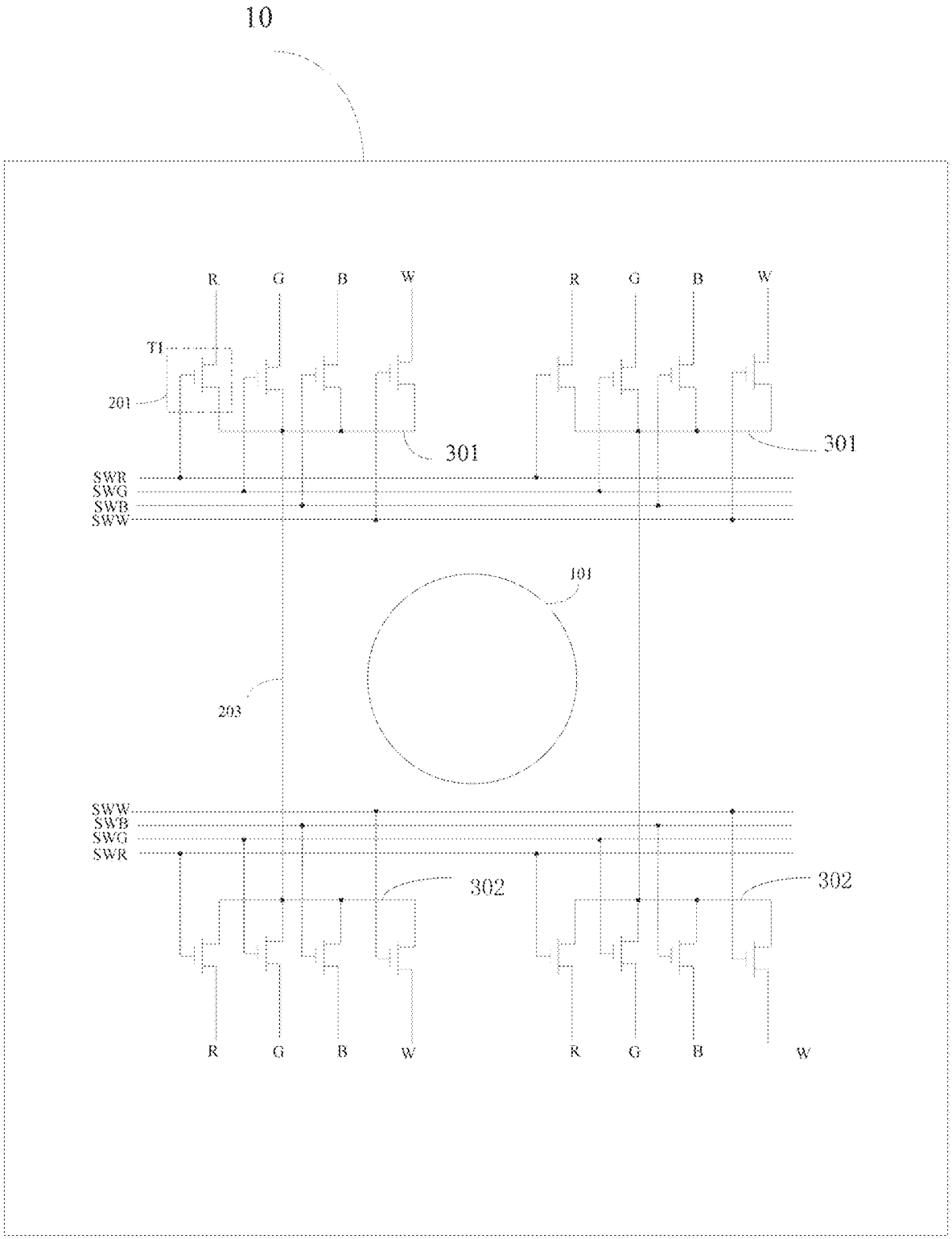
FIG. 5 is a schematic diagram showing a structure of a display substrate according to an embodiment of the disclosure.
Figure 6:
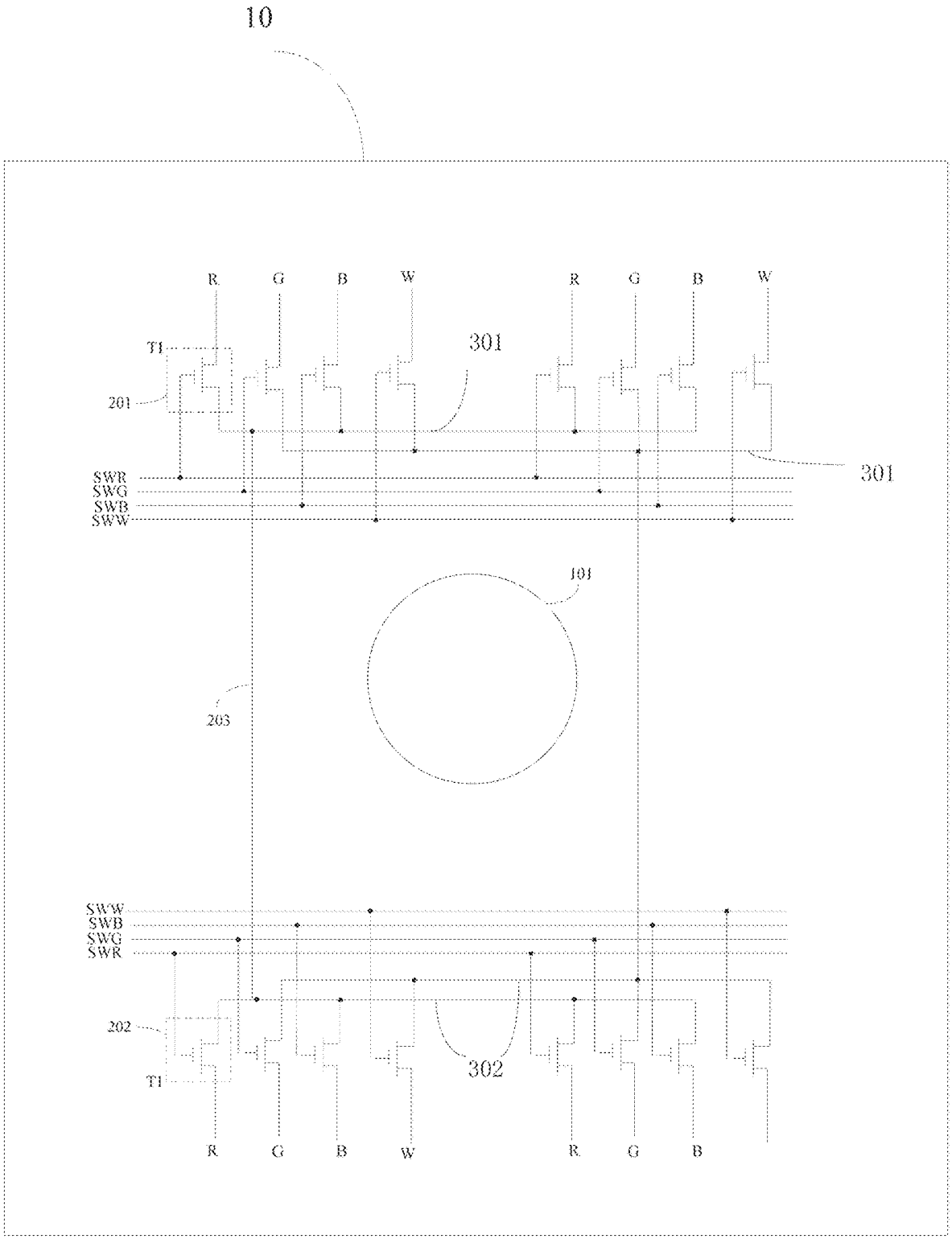
FIG. 6 is a schematic diagram showing a structure of a display substrate according to an embodiment of the disclosure.
Figure 7:
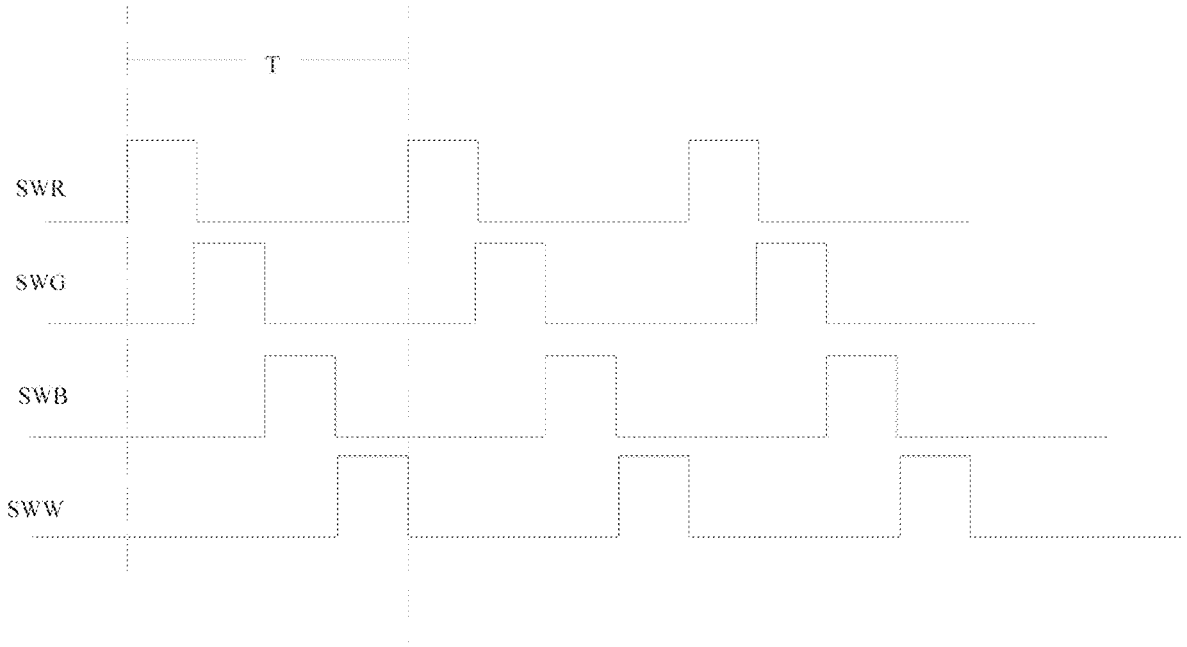
FIG. 7 is a waveform diagram showing a timing signal for controlling a display substrate according to an embodiment of the disclosure.

FIG. 5 is a schematic diagram showing a structure of a display substrate according to an embodiment of the disclosure. FIG. 6 is a schematic diagram showing a structure of a display substrate according to an embodiment of the disclosure. FIG. 7 is a waveform diagram showing a tinning signal for controlling a display substrate according to an embodiment of the disclosure.

In one embodiment, as shown in FIGS. 5 and 6, the display substrate includes a red sub-pixel R, a green sub-pixel G, a blue sub-pixel B, and a white sub-pixel W.

As shown in FIG. 5, four sequentially adjacent first switch transistors are grouped into one group, and four sequentially adjacent second switch transistors are grouped into another group. In this case, the connection relationship between each group of first switch transistors and a corresponding group of second switch transistors, the connection relationship between the transistors in each group and the timing signal terminals, and the connection relationship between the transistors in groups are similar to the case where three sequentially adjacent transistors are grouped into one group (as shown in FIG. 2), and thus detailed description will not be described herein.

As shown in FIG. 6, in the case where the display substrate includes red, green, blue and white sub-pixels R, G, B and W, the plurality of first switch transistors are sequentially numbered from left to right. The odd numbered first switch transistors are grouped into one group, and the even numbered first switch transistors are grouped into another group. Accordingly, the plurality of second switch transistors are numbered sequentially from left to right. The odd numbered second switch transistors are grouped into one group, and the even numbered second switch transistors are grouped into another group. In this case, the connection relationship between each group of first switch transistors and a corresponding group of second switch transistors, the connection relationship between the transistors in each group and the four (4) timing signal terminals, and the connection relationship between the transistors in each group are similar to those of the 3 sub-pixels shown in FIG. 3, and thus detailed description will not be repeated herein.

As shown in FIG. 7, in the case where the display substrate includes the red sub-pixel R, the green sub-pixel G, the blue sub-pixel B, and the white sub-pixel W, four (4) timing signal terminals including a first timing signal terminal SWR, a second timing signal terminal SWG, a third timing signal terminal SWB, and a fourth timing signal terminal SWW may be provided.

The first timing signal terminal SWR may output one square wave pulse occupying quarter cycle (i.e., T/4). The second timing signal terminal SWG may output one square wave pulse occupying quarter cycle immediately after the square wave pulse output from the first timing signal terminal SWR. The third timing signal terminal SWB may output one square wave pulse occupying quarter cycle immediately after the square wave pulse output from the second timing signal terminal SWG. The fourth timing signal terminal SWW may output one square wave pulse occupying quarter cycle immediately after the square wave pulse output from the third timing signal terminal SWB.

Figure 8:
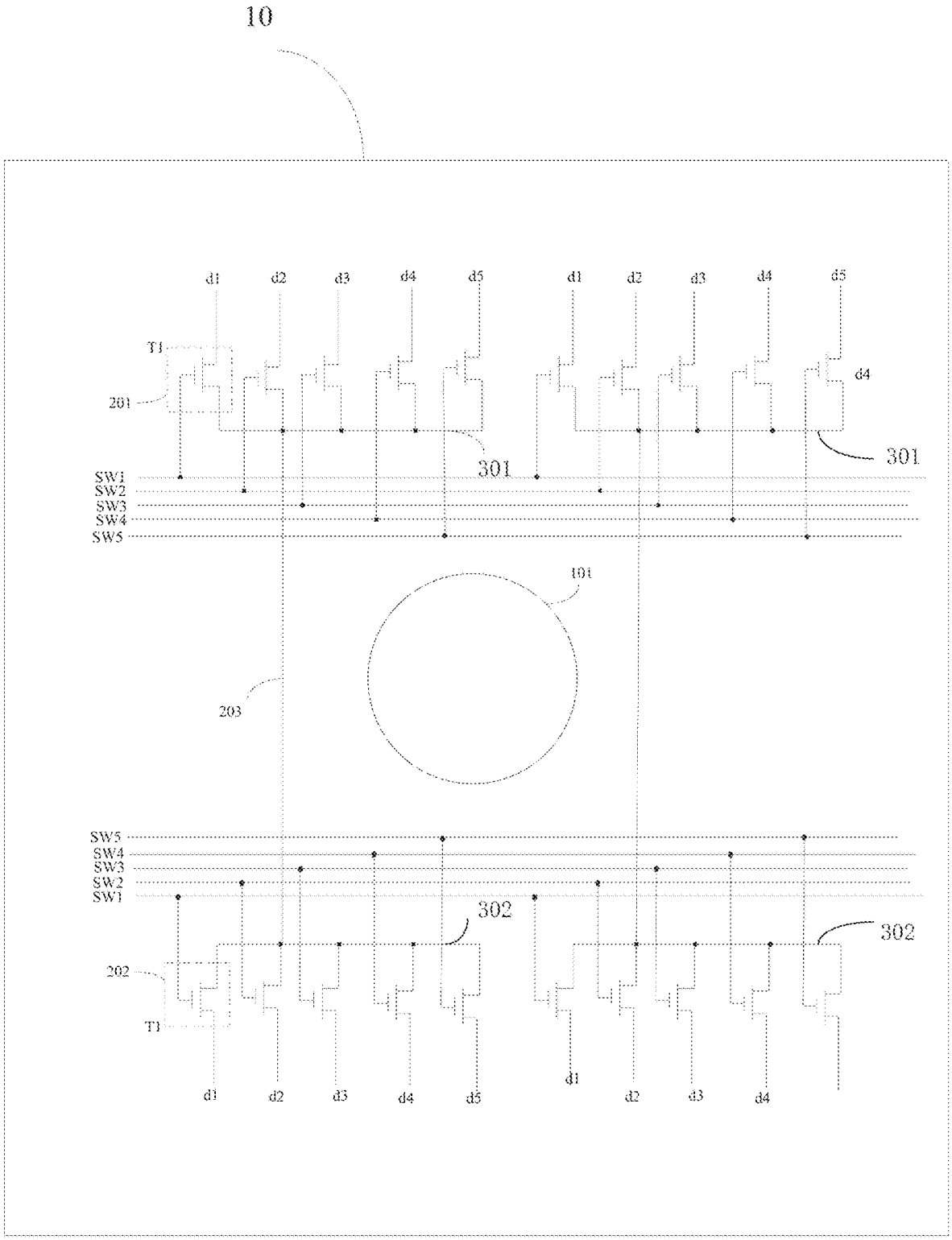
FIG. 8 is a schematic diagram showing a structure of a display substrate according to an embodiment of the disclosure.
Figure 9:
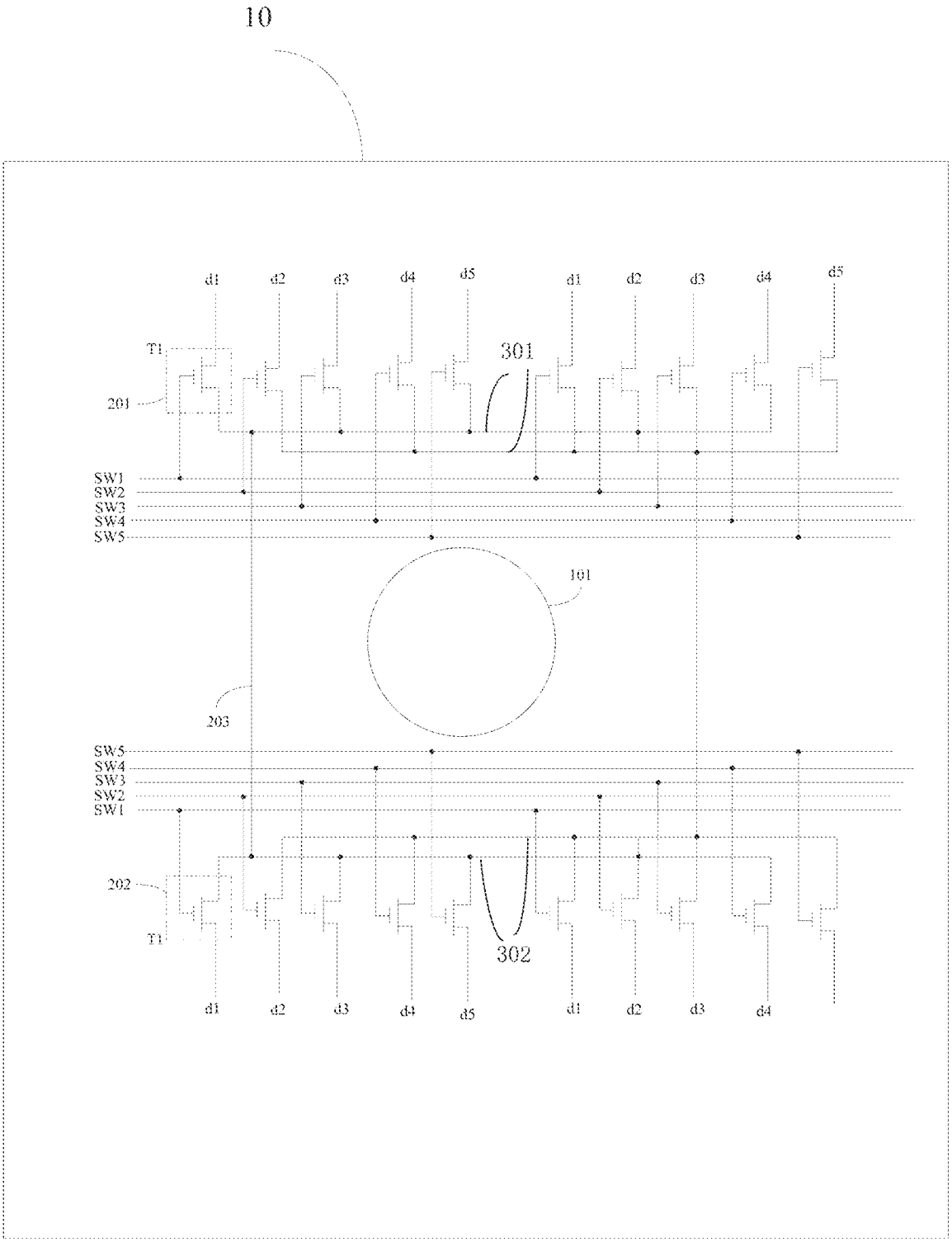
FIG. 9 is a schematic diagram showing a structure of a display substrate according to an embodiment of the disclosure.
Figure 10:
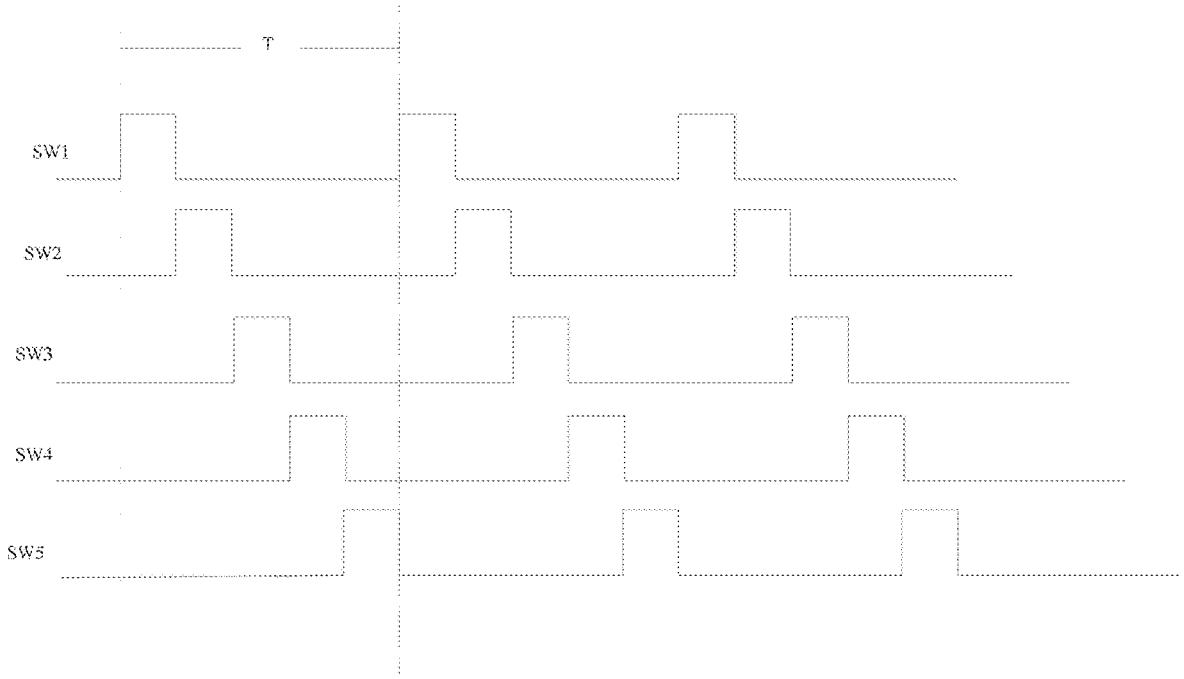
FIG. 10 is a waveform diagram showing a timing signal for controlling a display substrate according to an embodiment of the disclosure.

FIG. 8 is a schematic diagram showing a structure of a display substrate according to an embodiment of the disclosure. FIG. 9 is a schematic diagram showing a structure of a display substrate according to an embodiment of the disclosure, FIG. 10 is a waveform diagram showing a timing signal for controlling a display substrate according to an embodiment of the disclosure.

In one embodiment, as shown in FIG. 8, among ten (10) first switch transistors and ten (10) second switch transistors arranged in the order of R (d1), G (d2), B (d3), R (d4), G (d5), B (d6), R (d7), G (d8), B (d9), and R (d10), five (5) sequentially adjacent switch transistors are grouped into one group. In this case, the connection relationship between each group of first switch transistors and the corresponding group of second switch transistors, the connection relationship between the transistors in each group and the timing signal terminals, and the connection relationship between the transistors in each group are similar to the case where three sequentially adjacent transistors are grouped into one group (as shown in FIG. 2), and thus the detailed description will not described herein.

In one embodiment, as shown in FIG. 9, among ten (10) first switch transistors and ten (10) second switch transistors arranged in the order of R (d1), G (d2), B (d3), R (d4), G (d5), B (d6), R (d7), G (d8), B (d9), and r (d10), the odd-numbered first switch transistors or odd-numbered second switch transistors are grouped into one group, and the even-numbered first switch transistors or even-numbered second switch transistors are grouped into another group. In this case, the connection relationship between each group of first switch transistors and the corresponding group of second switch transistors, the connection relationship between the transistors in each group and five (5) timing signal terminals SW1, SW2, SW3, SW4, and SW5, and the connection relationship between the transistors in each group are similar to those of the 3 sub-pixels shown in FIG. 3, and thus the detailed description will not be described again here.

In the embodiment, five (5) timing signal terminals including a first timing signal terminal SW1, a second timing signal terminal SW2, a third timing signal terminal SW3, a fourth timing signal terminal SW4 and a fifth timing signal terminal SW5 may be provided.

As shown in FIG. 10, the first timing signal terminal SW1, the second timing signal terminal SW2, the third timing signal terminal SW3, the fourth timing signal terminal SW4 and the fifth timing signal terminal SW5 may sequentially output square wave pulses occupying one fifth cycle (i.e., T/5) at different times respectively.

The present embodiment may also have other variation examples. For example, four (4), six (6), seven (7) or more switch transistors arranged in RGBRGB order may be grouped into one group, and details will not be repeated here.

In an embodiment of the present disclosure, a method for driving a display substrate in any one of the above embodiments is provided. The method includes outputting, by the first timing signal terminal, a square wave pulse occupying one third of a cycle, so as to drive a first switch transistor and a second switch transistor coupled to the first timing signal terminal to be turned on; outputting, by the second timing signal terminal, a square wave pulse occupying one third of a cycle immediately after the square wave pulse output by the first timing signal terminal, so as to drive a first switch transistor and a second switch transistor coupled to the second timing signal terminal to be turned on; and outputting, by the third timing signal terminal, a square wave pulse occupying one third of a cycle immediately after the square wave pulse output by the second timing signal terminal, so as to drive a first switch transistor and a second switch transistor coupled to the third tinning signal terminal to be turned on.

A display device is provided in the embodiment of the present disclosure. The display device includes the display substrate according to the above embodiment and a driving circuit for driving the above display substrate. The display device may be a mobile phone, a tablet computer, a notebook computer, or other annular display devices. The principle of the display substrate is similar to that of the display substrate provided in the above embodiments, and details will not be repeated here.

It should be understood that the above implementations are merely exemplary embodiments for the purpose of illustrating the principles of the present disclosure, however, the present disclosure is not limited thereto. It will be apparent to those skilled in the art that various changes and modifications can be made without departing from the spirit and spirit of the present disclosure, which are also to be regarded as the scope of the present disclosure.

What is claimed is:

1. A display substrate comprising:

a base substrate with a hole in a hole region of the base substrate;

a plurality of first signal lines, on a first side of the hole;

a plurality of second signal lines, on the other side of the hole distal to the first side, the plurality of first signal lines being in one-to-one correspondence with the plurality of second signal lines, and both of the plurality of first signal lines and the plurality of second signal lines extending along a first direction;

a plurality of first switch transistors, at terminals of the plurality of first signal lines proximal to the hole and electrically coupled to the plurality of first signal lines in one-to-one correspondence;

a plurality of second switch transistors, at terminals of the plurality of second signal lines proximal to the hole and electrically coupled to the plurality of second signal lines in one-to-one correspondence;

a plurality of connection lines comprising a plurality of first connection lines, a plurality of second connection lines and a plurality of third connection lines, both of the plurality of first connection lines and the plurality of second connection lines extending along a second direction, the plurality of third connection lines extending along the first direction, and the first direction being substantially perpendicular to the second direction; and a plurality of timing signal lines, extending along the second direction; wherein all of second terminals multiple directly adjacent first switch transistors of the plurality of first switch transistors; are coupled together and coupled to a same first connection line of the plurality of first connection lines, first terminals of the multiple directly adjacent first switch transistors of the plurality of first switch transistors are respectively coupled to corresponding first signal lines of the plurality of first signal lines, and control terminals of the multiple directly adjacent first switch transistors of the plurality of first switch transistors are respectively coupled to different timing signal lines of the plurality of timing signal lines, all of second terminals of multiple directly adjacent second switch transistors of the plurality of second switch transistors are coupled together and coupled to a same second connection line of the plurality of second connection lines, first terminals of multiple directly adjacent second switch transistors of the plurality of second switch transistors are respectively coupled to corresponding second signal lines of the plurality of second signal lines, and control terminals of multiple directly adjacent second switch transistors of the plurality of second switch transistors are respectively coupled to the different timing signal lines of the plurality of timing signal lines, and all of the second terminals of the multiple directly adjacent first switch transistors of the plurality of first switch transistors are coupled to all of the second terminals of the multiple directly adjacent second switch transistors of the plurality of second switch transistors through a same third connection line of the plurality of third connection lines.

2. The display substrate of claim 1, wherein the plurality of timing signal lines are arranged on both sides of the hole in an axisymmetric manner with a straight line passing through a center of the hole along the second direction as an axis, and the plurality of timing signal lines are coupled to a plurality of timing signal terminals, respectively.

3. The display substrate of claim 2, wherein a control electrode of one first switch transistor and a control electrode of one corresponding second switch transistor are coupled to a same timing signal terminal.

4. The display substrate of claim 1, wherein the first signal line is a first data line, and the second signal line is a second data line.

5. The display substrate of claim 4, wherein the first data lines respectively correspond to a red sub-pixel, a green sub-pixel and a blue sub-pixel, the second data lines respectively correspond to red sub-pixel, a green sub-pixel and a blue sub-pixel, and a control electrode of one first switch transistor and a control electrode of one corresponding second switch transistor corresponding to a same color sub-pixel are coupled to a same timing signal terminal.

6. The display substrate of claim 5, wherein the same third connection line is electrically coupled to the first connection line and the second connection line at the green sub-pixel.

7. The display substrate of claim 5, wherein the plurality of timing signal terminals comprises a first timing signal terminal, a second timing signal terminal, and a third timing signal terminal, the plurality of timing signal lines comprises a first timing signal line, a second timing signal line, and a third timing signal line, a control electrode of a first switch transistor of the multiple directly adjacent first switch transistors corresponding to the red sub-pixel is coupled to the first timing signal terminal via the first timing signal line, and a control electrode of a second switch transistor of the multiple directly adjacent second switch transistors corresponding to the red sub-pixel is coupled to the first timing signal terminal via the first timing signal line, a control electrode of a first switch transistor of the multiple directly adjacent first switch transistors corresponding to the green sub-pixel is coupled to the second timing signal terminal via the second timing signal line, and a control electrode of a second switch transistor of the multiple directly adjacent second switch transistor corresponding to the green sub pixel is coupled to the second timing signal terminal via the second timing signal line, and a control electrode of a first switch transistor of the multiple directly adjacent first switch transistors corresponding to the blue sub-pixel is coupled to the third timing signal terminal via the third timing signal line, and a control electrode of a second switch transistor of the multiple directly adjacent second switch transistors corresponding to the blue sub-pixel is coupled to the third timing signal terminal via the third timing signal line.

8. The display substrate of claim 3, wherein each of the first switch transistor and the second switch transistor is N-type transistor.

9. The display substrate of claim 1, wherein an orthographic projection of the third connection line on the base substrate does not overlap an orthographic projection of the hole on the base substrate.

10. A display device comprising the display substrate of claim 1 and a driving circuit for driving the display substrate.

11. A method for driving the display substrate of claim 7, comprising:

outputting, by the first timing signal terminal, a square wave pulse occupying one third of a cycle, so as to drive a first switch transistor and a second switch transistor coupled to the first timing signal terminal to be turned on;

outputting, by the second timing signal terminal, a square wave pulse occupying one third of a cycle immediately after the square wave pulse output by the first timing signal terminal, so as to drive a first switch transistor and a second switch transistor coupled to the second timing signal terminal to be turned on; and outputting, by the third timing signal terminal, a square wave pulse occupying one third of a cycle immediately after the square wave pulse output by the second timing signal terminal, so as to drive a first switch transistor and a second switch transistor coupled to the third timing signal terminal to be turned on.

* * * * *